US007976084B2

(12) United States Patent
Møgedal et al.

(10) Patent No.: US 7,976,084 B2
(45) Date of Patent: Jul. 12, 2011

(54) LIGHT WEIGHT LIFTTING TOOL FOR LOWERING AND RETRIEVING SUBSEA EQUIPMENT

(75) Inventors: Knut Møgedal, Asker (NO); Øystein Møgedal, Oslo (NO)

(73) Assignee: Aker Kvaerner Subsea AS, Lysaker (NO)

( * ) Notice: Subject to any disclaimer, the term of this patent is extended or adjusted under 35 U.S.C. 154(b) by 516 days.

(21) Appl. No.: 12/084,299

(22) PCT Filed: Nov. 1, 2006

(86) PCT No.: PCT/NO2006/000392

§ 371 (c)(1),
(2), (4) Date: Apr. 29, 2008

(87) PCT Pub. No.: WO2007/053037

PCT Pub. Date: May 10, 2007

(65) Prior Publication Data

US 2008/0265596 A1 Oct. 30, 2008

(30) Foreign Application Priority Data

Nov. 1, 2005 (NO) ..... 20055107

(51) Int. Cl.
*B66C 1/62* (2006.01)

(52) U.S. Cl. ..... 294/66.1; 294/66.2; 294/82.35

(58) Field of Classification Search ..... 294/66.1, 294/66.2, 82.35, 86.26, 86.3, 119.1; 405/252.1
See application file for complete search history.

(56) References Cited

U.S. PATENT DOCUMENTS

| | | | | |
|---|---|---|---|---|
| 2,489,864 | A * | 11/1949 | Cravener | 294/82.35 |
| 3,795,420 | A * | 3/1974 | Preston, Jr. | 294/90 |
| 3,845,963 | A * | 11/1974 | Price | 279/89 |
| 4,214,842 | A * | 7/1980 | Franks | 405/191 |
| 4,476,086 | A * | 10/1984 | Kerz | 376/219 |
| 4,585,369 | A * | 4/1986 | Manesse et al. | 403/322.3 |
| 5,318,384 | A | 6/1994 | Maloberti et al. | |
| 5,540,523 | A | 7/1996 | Foret, Jr. et al. | |
| 5,688,012 | A | 11/1997 | Siesjo et al. | |
| 7,648,183 | B2 * | 1/2010 | Cornwell | 294/90 |

FOREIGN PATENT DOCUMENTS

| | | | |
|---|---|---|---|
| FR | 2.210.563 | | 7/1974 |
| GB | 1 554 961 | A | 10/1979 |
| GB | 2 214 158 | A | 8/1989 |
| GB | 2 417 233 | A | 2/2006 |
| JP | 2001-173352 | A | 6/2001 |
| WO | WO-91/15397 | A1 | 10/1991 |

* cited by examiner

*Primary Examiner* — Dean J Kramer

(74) *Attorney, Agent, or Firm* — Birch, Stewart, Kolasch & Birch, LLP

(57) ABSTRACT

A light weight lifting tool (10) for lowering and retrieving subsea equipment to and from the sea bed is disclosed. The equipment includes an upper coupling part in the form of a connector spool piece (15) having at least one circumferential ring groove (16) for use in making engagement with the lifting tool (10). The lifting tool (10) includes a housing (1) designed to enclose and receive the connector spool piece (15). The lifting tool (10) further includes a number of latch segments (8) having at least one radially inwards directed projection (8') designed for engagement with the at least one ring groove (16), and an activating device (6) arranged to bring the latch segments (8) in and out of engagement with the at least one ring groove (16) by operation of the activating device (6).

14 Claims, 4 Drawing Sheets

Figure 4:
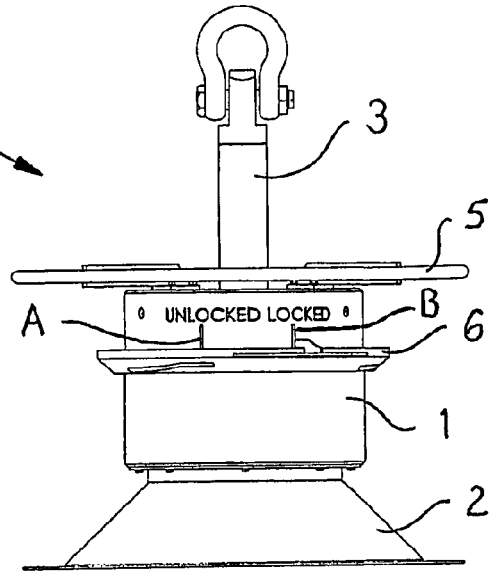

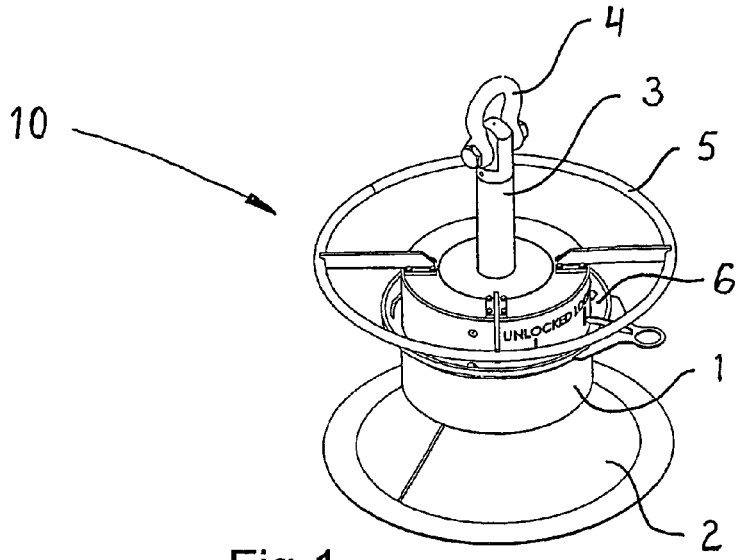
Fig.1.
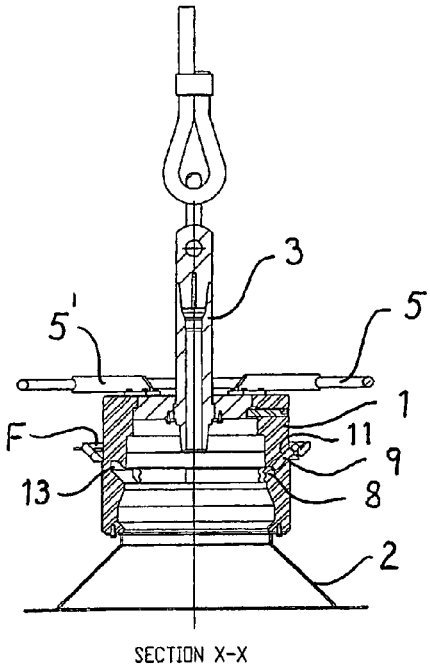
Fig.3.
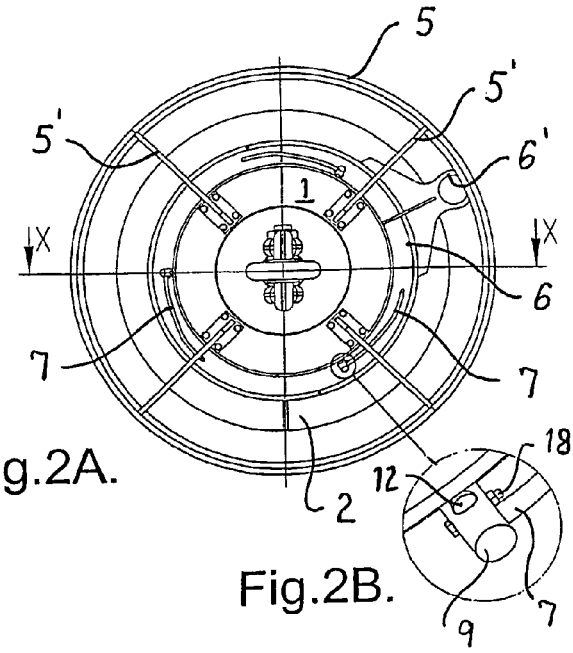
Fig.2A.
Fig.2B.

LIGHT WEIGHT LIFTTING TOOL FOR LOWERING AND RETRIEVING SUBSEA EQUIPMENT

The present invention relates to a light weight lifting tool for lowering and retrieving subsea equipment, including an upper coupling part in the form of a connector spool piece having at least one circumferential ring groove for use in making engagement with the lifting tool, which lifting tool comprises a housing designed to enclose and receive the connector spool piece. One example of such subsea equipment is a x-mas tree that is located on the sea bed and is mounted to a well head.

Traditional lifting tools for subsea equipment, in particular for x-mas trees, are relatively heavy having integrated hydraulic systems for operation of the connector. Typical weight for such a tool can be 15 tons. This may, however, create limitations as to which vessels that can be used in such an operation. In order to reduce the lifting weight as much as possible, it is desired to have a simple and light weight lifting tool available. There has also been made such simple tools previously, but the operation of the connector itself that locks the tool to the x-mas tree, has then been designed such that it has been necessary with several ROV (remote operated vehicle) operations. And typically, in such a way that the ROV needs to screw in several locking bolts around the circumference of the connector.

By the device described below, the ROV only needs to perform one single operation to lock, or optionally unlock, the connector.

According to the present invention it is provided a light weight lifting tool of the introductory said kind, which is distinguished in that the lifting tool further includes a number of latch segments having at least one radially inwards directed projection designed for engagement with said at least one ring groove, and an activating device arranged to bring said latch segments in and out of engagement with said at least one ring groove by operation of the activating device.

In one suitable embodiment an activating pin is connected to each individual latch segment, and the activating pin extends outwardly through the wall of the housing. The activating pin points outwards in a radial direction, still inclined relative to a cross sectional plane. It is a benefit that the segments move in the same direction as the underside of the ring groves in the connector spool piece. It is hereby achieved both that the forces through the connector does not have any component in the moving direction of the segments and thus assures that they are not moving inadvertently, and that the motion of the segments do not require any relative motion between the lifting tool and the object to be lifted.

Preferably the activating device comprises a loosely connected activating ring which circumscribes the housing. The activating device further includes a number of coulisse slots that receive respective activating pin. Each coulisse slot extends substantially circumferential to the housing, though increases steadily in distance from the external wall of the housing in one direction thereof. In cooperation with the activating pin, the coulisse slot will bring the respective latch segments back and forth in radial direction during circumferential turning of the activating ring.

Suitably the respective latch segments are received in internal circumscribing groves in the housing thus controlling the limited motion of the latch segments in substantially the radial direction.

Preferably the internal circumscribing grove will extend upwardly inclined relative to the lifting motion.

Normally the activating device will be operated by a ROV.

In a suitable embodiment of the light weight lifting tool, the tool includes three arched latch segments, each spanning over an arch of approximately 120°.

Preferably the light weight lifting tool has means for attachment of a ROV.

Further, the light weight lifting tool will normally have a funnel formed part that is arranged in the lower end of the housing in order to guide the tool down over the spool piece or a so-called H4 profile.

Suitably the light weight lifting tool is arranged so that the motions of the segments take place in the same direction as the direction of the underside of the ring groves in the connector spool piece.

Figure 5:
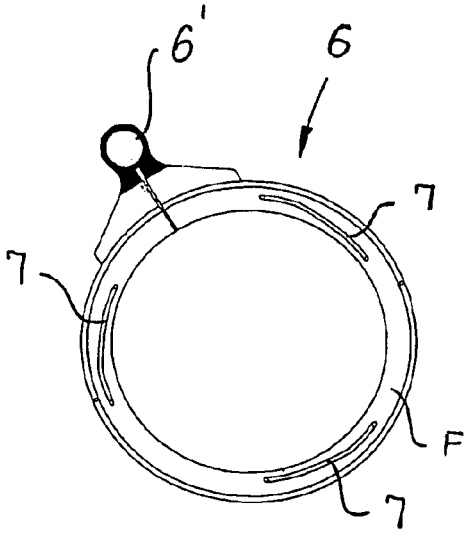
Figure 6:
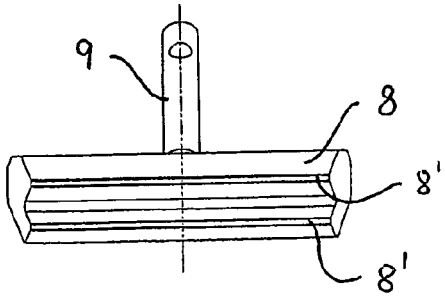
Figure 8:
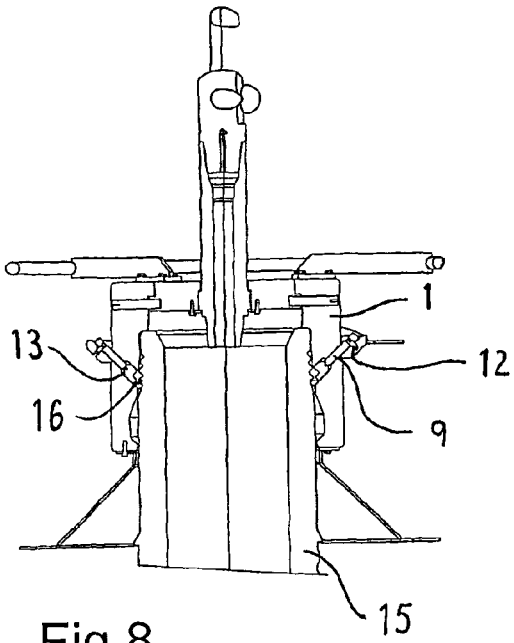
Figure 7:
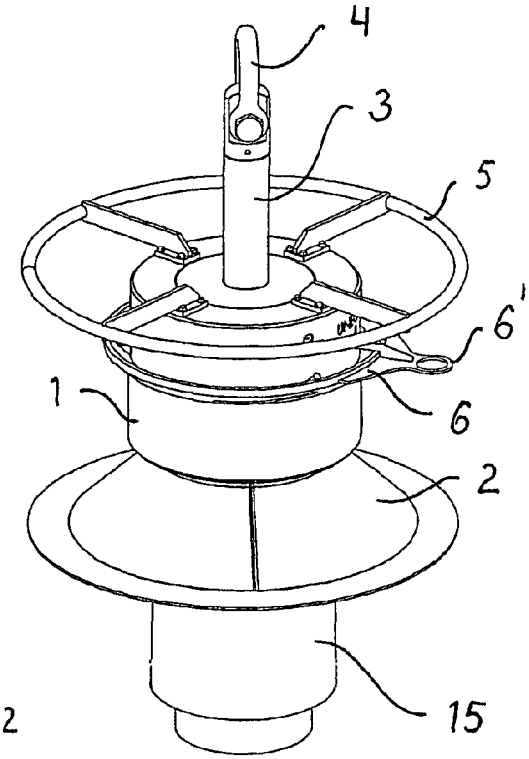
Figure 9:
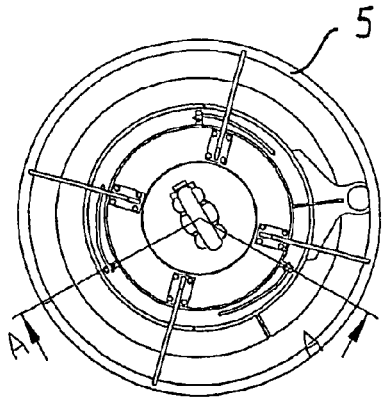
Figure 10:
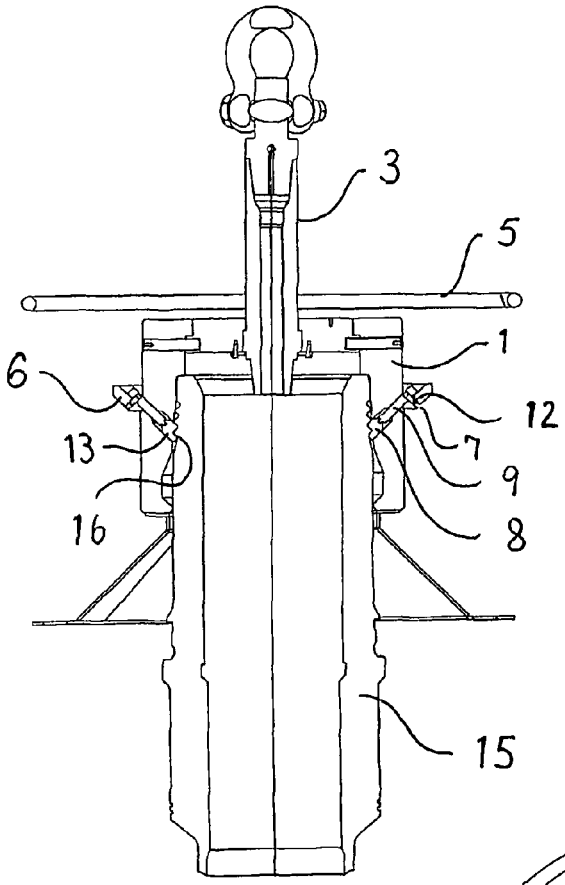
Figure 11:
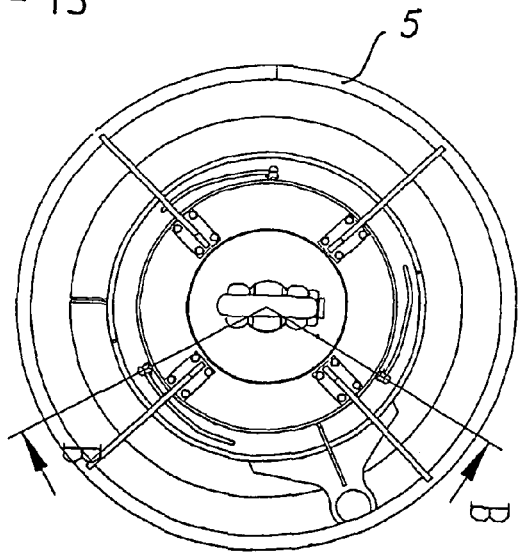

Other and further objects, features and advantages will appear from the following description of the invention, which is given for the purpose of description, without thereby being limiting, and given in context with the appended drawings where:

FIG. 1 shows in perspective view a light weight lifting tool according to the invention for use in lifting subsea equipment, FIG. 2A shows a view from above of the lifting tool according to FIG. 1, FIG. 2B shows a detailed view of the encircled part of FIG. 2A, FIG. 3 shows an axial section through the lifting tool shown in FIG. 1 and along the line X-X in FIG. 2A, FIG. 4 shows an elevation view of the lifting tool which illustrates the lifting positions, FIG. 5 shows a view of the activating ring, FIG. 6 shows a view of an arched locking segment having attached activating pin, FIG. 7 shows in perspective view the lifting tool according to FIG. 1 placed over a connector spool piece, FIG. 8 shows a section along the angular line A-A in FIG. 9 that shows the lifting tool in a non activated position, FIG. 9 shows the tool from above, FIG. 10 shows a section along the angular line B-B in FIG. 11 that shows the lifting tool in activated locking position between the connector spool piece and the lifting tool, and FIG. 11 shows the tool viewed from above.

FIG. 1 shows a lifting tool 10 according to the invention that has particularly low weight compared with similar tools that are used to similar purposes. The lifting tool 10 includes a tool housing 1 that has a cavity which can be thread over a connecting part in the form of a connector spool piece, or so-called H4 profile, which is part of that subsea equipment to be lifted up from the sea bed. A funnel formed body 2 is attached to the lower end of the tool housing 1. The funnel formed body 2 is designed to be able to guide the tool 10 down onto the connector spool piece and align the parts relative to each other.

Further a lifting stick 3 is attached to the lifting tool 10 and has a lifting shackle 4 in its upper end. The lifting shackle 4 in turn is in connection with conventional lifting equipment (not shown) on the sea floor. A device 5 for attachment of a ROV is also fixedly mounted to the tool housing 1.

An activating device 6 is arranged externally around the tool housing 1. The activating device 6 is loosely supported to the external surface of the tool housing 1. The activating device 6 can be turned relative to the tool housing 1, but is not able to be moved substantially in the axial direction relative to each other.

In FIG. 2A the lifting tool 10 is viewed right from above and the attachment means 5 for a ROV appears as a ring having four spokes 5' that makes up the fixed connection to the tool housing 1. Further it appears that the activating device 6 has three coulisse slots formed therein. It also has a connecting lug 6' which is designed for engagement with an arm (not shown) on a ROV (not shown) which is able to operate the connecting lug 6'. By operating the connecting lug 6' the activating device 6 is turned relative to the tool housing 1.

A number of latching or locking segments 8 that are shown in FIG. 3 are actuated by such turning of the activating device 6. The number of latch segments 8 are three in the illustrated embodiment, but this number can vary according to desire/need. The tool housing 1 has groves 13 that control or guide the respective latch segments 8 during actuation. The activating device 6 is connected to respective latch segments 8 via an activating pin 9. The activating pin 9 is connected to the latch segment 8 in its lower end and extends through an opening 11 in the tool housing 1 and abuts against the top side of the activating device 6. A peg 12 projects from the activating pin 9 and down into the coulisse slot 7 and is so arranged that it can not slip out from the coulisse slot 7. The peg 12 is locked by a locking bolt 18. See FIGS. 2B, 8 and 10.

When viewed in the circumferential direction and counter clockwise, each coulisse slot 7 extends such that the distance to the tool housing 1 slightly increases. In turning the activating device 6 clockwise, each peg 12 will be actuated by corresponding coulisse slot 7. The coulisse slot 7 pulls the peg 12 outwards in respect of the tool housing 1 and thus pulls the associated activating pin 9 up into the aperture 11 in the tool housing 1. Consequently, also the associated latch segment 8 is pulled in the same direction, i.e. out of possible engagement with a connector spool piece 15, see FIG. 7-11.

FIG. 4 shows a side view of the lifting tool 10 and illustrates two indicators A and B for the positions "Locked" and "Unlocked" that the tool provides. These positions can be set and inspected by a ROV.

FIG. 5 shows the activating ring 6 in closer detail and as an individual part where the coulisse slots 7 are clearly revealed. The connecting pipe 6' for ROV appears clearly and may, as an option, be coated with marking color. Even though not strictly necessary, the activating device 6 has a shape as a very short, squarely truncated funnel having surfaces F that are inclined relative to the external surface of the tool housing 10. The surfaces F preferably slant by the same inclination as the ring grove 13 and the activating pin 9 in the housing 1 such that that part of the activating pin 9 projecting out from the housing 1 is abutting the internal surface F on the activating ring 6.

FIG. 6 shows a locking segment 8 in closer detail and with attached activating pin 9. Normally, as mentioned, three such locking segments 8 will be arranged around the internal circumference, but a different number is also possible. The locking segments 8 can be adjacent to each other or spaced apart in the circumferential direction. The segments 8 have one or more projections 8' which is/are designed for secure engagement with at least one ring grove 16 on the connector spool piece 15. See FIGS. 8 and 10. The motion of the segments 8 preferably takes place in the same direction as the directions on the underside of the ring groves 16 in the connector spool piece 15.

FIG. 7 shows the light weight lifting tool 10 mounted onto a connector spool piece 15 which is part of the object (not shown) to be lifted up from the sea bed.

FIG. 8 shows a longitudinal cross section through the tool housing 1 along the line A-A marked in FIG. 9. Note that the line A-A forms an angle with breakpoint along the longitudinal axis of the tool 10. This is drawn like this in order to get illustrated a section through the activating pins 9 and the pegs 12 and their cooperation with the coulisse slots 7. The locking segments 8 are here shown pulled fully up into the guiding track 13 that guide the locking segments 8 in their movement in and out of engagement with the circumferential grove 16 provided on the connector spool piece 15. The lifting tool 10 is thus not locked to the connector spool piece 15.

FIG. 10 also shows a longitudinal section through the tool housing 1, now, however, when the lifting tool 10 is locked to the connector spool piece 15. The longitudinal section is taken along the line B-B marked on FIG. 11 and also forms an angle with breakpoint along the longitudinal axis of the tool 10.

It is to be noted that it is an advantage that the latch segments 8 are moving in the same direction as the underside of the ring groves 16 in the connector spool piece 15. Thus it is achieved that both the forces through the connector 15 do not have any component in the moving direction of the locking segments 8 and thus assures that these are not moving unintentionally, and that the movement of the latch segments 8 do not require any relative motion between the lifting tool 10 and the object to be lifted via the connector spool piece 15.

The invention claimed is:

1. A light weight lifting tool (10) for lowering and retrieving subsea equipment, including an upper coupling part in the form of a connector spool piece (15) having at least one circumferential ring groove (16) for use in making engagement with the lifting tool (10), said lifting tool (10) comprises:

a housing (1) designed to enclose and receive the connector spool piece (15), a number of latch segments (8) having at least one radially inwards directed projection (8') designed for engagement with said at least one ring groove (16), and an activating device (6) arranged to bring said latch segments (8) in and out of engagement with said at least one ring groove (16) by operation of the activating device (6), and an activating pin (9) connected to each of the individual latch segments (8), each of the activating pins (9) extending out through an external wall of the housing (1), wherein the activating device (6) comprises:

a loosely connected activating ring which circumscribes the housing (1), a number of coulisse slots (7) adapted to receive respective activating pins (9), wherein each of coulisse slots (7) extends substantially circumferentially to the housing (1), while steadily increasing in distance from the external wall of the housing (1) in one direction thereof, and each of the coulisse slots (7) in cooperation with the respective activating pin (9) brings the respective latch segments (8) back and forth in a radial direction during circumferential turning of the activating ring.

2. A light weight lifting tool according to claim 1, wherein the respective latch segments (8) are received in internal circumscribing groves (13) in the housing (1) which control a limited motion of the latch segments (8).

3. A light weight lifting tool according to claim 2, wherein the latch segments (8) include three arched latch segments (8) spaced approximately 120° apart.

4. A light weight lifting tool according to claim 2, further comprising a device (5) for attachment of a remote operated vehicle.

5. A light weight lifting tool according to claim 1, wherein an internal circumscribing grove (13) is inclined upwards relative to the lifting motion.

6. A light weight lifting tool according to claim 5, wherein the latch segments (8) include three arched latch segments (8) spaced approximately 120° apart.

7. A light weight lifting tool according to claim 5, further comprising a device (5) for attachment of a remote operated vehicle.

8. A light weight lifting tool according to claim 1, wherein the activating device (6) is operated by a remote operated vehicle.

9. A light weight lifting tool according to claim 8, wherein the latch segments (8) include three arched latch segments (8) spaced approximately 120° apart.

10. A light weight lifting tool according to claim 8, further comprising a device (5) for attachment of a remote operated vehicle.

11. A light weight lifting tool according to claim 1, wherein the latch segments (8) include three arched latch segments (8) spaced approximately 120° apart.

12. A light weight lifting tool according to claim 1, further comprising a device (5) for attachment of a remote operated vehicle.

13. A light weight lifting tool according to claim 1, further comprising a funnel formed part (2) is arranged at the lower end of the housing (1).

14. A light weight lifting tool according to claim 1, wherein the movement of the latch segments (8) take place in the same direction as directions of the underside of the ring groves (16) in the connector spool piece (15).

* * * * *